US006758774B2

(12) United States Patent
Liechty, II

(10) Patent No.: US 6,758,774 B2
(45) Date of Patent: Jul. 6, 2004

(54) ARROWHEAD WITH RECESSED COLLAR

(76) Inventor: Victor Jay Liechty, II, 1250 N. 1750 W., Provo, UT (US) 84604

( * ) Notice: Subject to any disclaimer, the term of this patent is extended or adjusted under 35 U.S.C. 154(b) by 0 days.

(21) Appl. No.: 09/954,524

(22) Filed: Sep. 17, 2001

(65) Prior Publication Data

US 2002/0098926 A1 Jul. 25, 2002

Related U.S. Application Data

(63) Continuation of application No. 08/834,478, filed on Apr. 11, 1997, now Pat. No. 6,287,224.

(51) Int. Cl.[7] ..... F42B 6/08
(52) U.S. Cl. ..... 473/589; 473/584
(58) Field of Search ..... 473/578, 583, 473/584, FOR 216, FOR 221, FOR 222

(56) References Cited

U.S. PATENT DOCUMENTS

| | | | | |
|---|---|---|---|---|
| 1,604,713 | A | | 10/1926 | Norlund |
| 2,289,284 | A | | 7/1942 | Chandler |
| 2,568,417 | A | | 9/1951 | Steinbacher |
| 2,620,190 | A | | 12/1952 | Bean |
| 2,820,634 | A | | 1/1958 | Vance |
| 2,939,708 | A | | 6/1960 | Scheib |
| 2,993,697 | A | | 7/1961 | Urban |
| 3,000,635 | A | | 9/1961 | Nieman |
| 3,014,305 | A | | 12/1961 | Yurchich |
| 3,022,077 | A | | 2/1962 | Doonan |
| 3,036,395 | A | | 5/1962 | Nelson |
| 3,036,396 | A | * | 5/1962 | Swails |
| 3,064,977 | A | | 11/1962 | Zwickey |
| 3,138,383 | A | | 6/1964 | McKenzie |
| 3,168,313 | A | * | 2/1965 | Lint |
| 3,241,836 | A | | 3/1966 | Zwickey |
| 3,578,328 | A | | 5/1971 | Rickey |
| 3,600,835 | A | | 8/1971 | Hendricks |
| 3,738,657 | A | | 6/1973 | Cox |
| 3,759,519 | A | | 9/1973 | Palma |
| 4,099,720 | A | | 7/1978 | Zeren |
| 4,166,619 | A | | 9/1979 | Bergmann et al. |
| 4,452,460 | A | | 6/1984 | Adams |
| 4,504,063 | A | | 3/1985 | LeBus |
| D279,813 | S | | 7/1985 | Palizzolo |
| 4,565,377 | A | | 1/1986 | Troncoso et al. |
| 4,579,348 | A | | 4/1986 | Jones |
| 4,615,529 | A | | 10/1986 | Vocal |
| 4,729,320 | A | | 3/1988 | Whitten |
| 4,807,382 | A | | 2/1989 | Albrecht ..... 43/6 |
| 4,932,671 | A | | 6/1990 | Anderson |
| 4,940,246 | A | | 7/1990 | Stagg |
| 4,973,060 | A | | 11/1990 | Herzing |
| 4,976,443 | A | | 12/1990 | DeLucia |

(List continued on next page.)

OTHER PUBLICATIONS

Packaging: "Mini–Max3", Mar–Den Inc. Wilcox, AZ.
Packaging: "JackHammer–SST" WASP Archery Products Inc. Plymouth, CT.
Advertisement: Rocket Aeroheads—Steelhead 125 Bow Masters Nov. 1998, p. 23.
Advertisement: Knife Wing Arrowheads—Knife Wing II as in ABCC"ad book" 4th ed. Apr. 1, 1995, p. K–2.
Shockwove Mechanical Broodhead—New Archery Products Archery Business May/Jun. 1999, p. 7.

*Primary Examiner*—John A. Ricci

(57) ABSTRACT

Arrowheads, including blade-opening arrowheads as well as other non blade-opening arrowheads having a recessed collar or body that is slidably positionable about a stem portion thereof. The recess bounds and defines an internally contained void of the arrowheads. The collar is defined by having an internal centrally disposed bore extending therethrough so as to enable the collar or washer to be slidably positioned about an extending post or stem member of a corresponding arrowhead body. The collar and created internal void at least in part aid in attaching blades to the respective arrowhead bodies and serve to house various different annular elements that circumscribe the post member or equivalent.

35 Claims, 13 Drawing Sheets

U.S. PATENT DOCUMENTS

| | | | | | |
|---|---|---|---|---|---|
| 4,988,112 | A | | 1/1991 | Anderson et al. | |
| 4,998,738 | A | | 3/1991 | Puckett | |
| 5,044,640 | A | | 9/1991 | DelMonte et al. | |
| 5,046,744 | A | | 9/1991 | Eddy | |
| 5,066,021 | A | * | 11/1991 | DeLucia | |
| 5,078,407 | A | | 1/1992 | Carlston et al. | |
| 5,082,292 | A | | 1/1992 | Puckett et al. | |
| 5,083,798 | A | | 1/1992 | Massey | |
| 5,090,709 | A | | 2/1992 | Johnson | |
| 5,100,143 | A | * | 3/1992 | Puckett | |
| 5,102,147 | A | | 4/1992 | Szeluga | |
| 5,112,063 | A | | 5/1992 | Puckett | |
| 5,172,916 | A | | 12/1992 | Puckett | |
| 5,178,398 | A | | 1/1993 | Eddy | |
| 5,286,035 | A | | 2/1994 | Ward | |
| 5,322,297 | A | | 6/1994 | Smith | |
| 5,458,341 | A | | 10/1995 | Forrest et al. | |
| 5,472,213 | A | | 12/1995 | Dudley | |
| 5,564,713 | A | | 10/1996 | Mizek et al. | |
| 5,803,844 | A | | 9/1998 | Anderson | 473/583 |
| 5,803,845 | A | * | 9/1998 | Anderson | 473/583 |
| 5,820,498 | A | * | 10/1998 | Maleski | 473/584 |
| 5,857,930 | A | | 1/1999 | Troncoso | 473/583 |
| 5,879,252 | A | | 3/1999 | Johnson | 473/583 |

* cited by examiner

ARROWHEAD WITH RECESSED COLLAR

This application is a Continuation of application Ser. No. 08/834,478, filed Apr. 11, 1997, now U.S. Pat. No. 6,287, 224.

BACKGROUND—FIELD OF THE INVENTION

This invention relates to arrowheads having a recessed collar or body that is slidably positionable about a stem portion thereof.

BACKGROUND—DESCRIPTION OF PRIOR ART

Arrows have long been used for war, hunting and competitive sports. A conventional arrow has a shaft, a nock at one end that receives the bow string, an arrowhead or point that attaches to the opposite end, and fletchings. The fletchings are glued to the shaft near the nock end, and help to stabilize the arrow in flight, as it rotates. Arrowheads generally have a pointed forward end, and an opposite threaded shaft end that attaches the arrowhead to the arrow shaft. Arrowheads are also attached to the forward end of arrow shafts by glueing and other methods.

Arrowheads come in a variety of different sizes and configurations depending on their intended use. For example, there are specifically designed arrowheads for competitive target shooting, shooting fish, hunting birds or small game animals, and for hunting big game animals.

The most common type of arrowhead used in hunting is the fixed-blade arrowhead, which has a pointed tip end used for penetrating, and blades that each have a razor sharp edge for cutting. Most conventional fixed-blade arrowheads have replaceable blades which are held in a fixed position on the arrowhead. The replaceable blades attach to the arrowhead body in longitudinal grooves called blade slots. The tip of the arrowhead may be separably attachable to the arrowhead body or may be integral with it. Arrowheads for hunting are generally known as broadheads.

Arrowheads used for hunting kill the game animal by cutting vital organs such as the lungs and vascular vessels such as arteries, which causes rapid hemorrhaging and/or suffocation. Quick and humane kills are dependent on accurate shot placement, and upon the amount or volume of the animal tissue that is cut. Hunting arrowheads that cut more tissue are more lethal, and therefore are better. The volume of tissue that is cut is determined by the cutting diameter of the arrowhead, the number of blades it contains, and by the distance the arrowhead penetrates into the animal. The cutting diameter of an arrowhead is determined by how far each cutting blade extends outward from the arrowhead body. The further the blades extend outward the larger the cutting diameter is, and therefore the more cutting potential the arrowhead has.

A problem with conventional fixed-blade arrowheads is that having the desirable, large cutting diameters generally cause unstable arrow flight or poor arrow aerodynamics, which affects accurate shot placement. This can lead to non-lethal wounding of the game animal or missing the animal altogether. Unstable arrow flight in hunting arrows is generally caused by arrowhead aligning and centering problems. Arrowhead aligning and centering problems are prevalent when the arrowhead is attached to the arrow shaft such that the longitudinal axis of the arrowhead is not in line with the longitudinal axis of the arrow shaft. Alignment and centering problems in arrowheads are generally created by low tolerances or sloppiness in the manufacturing of the arrowhead body. When a mis-aligned arrowhead is attached to an arrow and the arrow is shot, as the arrow spins or rotates in flight non-stabilizing forces are induced on the front end of the arrow and cause inconsistent or erratic flight, which steers the arrow from its intended path. Since the cutting blades of fixed-blade arrowheads extend out from the arrowhead body when the arrowhead is in flight, the blades greatly magnify any non-stabilizing forces induced on the arrow from misalignment, and therefore increase erratic arrow flight. This is the main reason why conventional fixed-blade arrowheads are limited in the maximum cutting diameter they can have, while retaining sufficiently stable aerodynamics.

To create a hunting arrowhead that has both a maximum cutting diameter and stable aerodynamics, despite moderate manufacturing tolerances, blade-opening arrowheads were designed. Blade-opening arrowheads differ from conventional fixed-blade arrowheads in that the cutting blades are folded up or held adjacent to the arrowhead body in a retracted position while the arrow is in flight, but at impact with the game animal rotate or pivot into an open position, therefore exposing the sharp blade edges and cutting the animal. Since the blades of blade-opening arrowheads are held adjacent to the arrowhead body and do not extend very far out from it, any aligning or centering problems of a blade-opening arrowhead attached to an arrow will not noticeably steer the arrow or undesirably affect its flight trajectory. In this manner blade-opening arrowheads can have both a desirable large cutting diameter, and the stable arrow flight characteristics necessary for accurate shot placement. Blade-opening arrowheads can therefore potentially be more lethal.

Blade-opening arrowheads like conventional fixed blade arrowheads generally have an elongated arrowhead body, a tip end, and a threaded opposite end. The blades of blade-opening arrowheads have an attachment end which attaches the blades to the arrowhead body by a pivot pin, so that the blades can pivot or rotate between the retracted position and the open position. Blade-opening arrowheads also come in a variety of different types and styles. The blades of the most common type of blade-opening arrowheads, when in the retracted position have a leading blade end positioned near the tip of the arrowhead that protrudes outward from the arrowhead body, and is some times shaped like a wing. The leading blade ends of the most common type of blade-opening arrowheads, rotate away from the arrowhead body in a rearward direction when penetrating an animal. Particularly, the leading blade ends catch on the animal's surface and serve to lever or rotate the blades into the open position. The blades of blade-opening arrowheads are also received in blade slots, which are machined or formed into the side of the arrowhead body.

Blade-opening arrowheads for hunting big game must be non-barbing, wherein the blades when in the open position must not inhibit or prevent arrow extraction from a game animal by barbing into the animal tissue. This makes it so non-fatally wounded animals can easily pull out an arrow still lodged in them. For an arrowhead to be non-barbing, the pivotal blades must rotate from the open position to an angle greater than ninety degrees, as measured between the rear edge of each blade and a location on the arrow shaft rearward of the blades.

Blade-opening arrowheads generally do not penetrate as deep as conventional fixed-blade arrowheads. Sometimes in hunting situations an arrow will not completely pass through the game animal and will not have sufficiently cut any vital organs or vascular vessels, and thus not having inflicted a lethal wound. Sometimes in these instances the arrowhead will have penetrated within the game animal near an artery or vital organ such that as the animal retreats, the arrowhead continues to cut as it moves within the animal, and the artery or vital organ is severed, and the animal is harvested. Conventional blade-opening arrowheads are generally not as lethal in these types of situations, as arrowheads having the cutting blades positioned near the tip of the arrowhead, such as conventional fixed-blade arrowheads. This is because the cutting blades of the most popular types of conventional blade-opening arrowheads when in the open position, are positioned approximately one and a half inches back from the arrowhead tip, and therefore cut a lesser volume of tissue despite equal arrowhead penetration depth.

To hold the blades of blade-opening arrowheads in the retracted position during flight until the arrowhead penetrates the animal, annular retention members such as O-rings are most commonly used. Other commonly known annular retention members are, rubber bands, tight fitting plastic sleeves, tape, heat-shrinkable fitting plastic sleeves, and other wrap materials. When the O-rings are stretched around the outside of the blades they exert a resistive force against the blades and hold the blades selectively in the retracted position.

O-ring use for blade retention is less than ideal. The elastomeric polymer materials are susceptible to drying-out and therefore cracking, which can lead to breaking of the O-ring during arrow acceleration when the arrow is shot. This will cause premature blade-opening and produce extremely erratic arrow flight and possible non-lethal wounding of the game animal. This may also cause severe lacerations to the archer. Also, bows shooting arrows at very high speeds can require as many as three O-rings to prevent premature blade-opening. The experience of learning this can be very undesirable for the archer. O-rings are a consumable item designed for one shot use, and the cost of constantly replacing them is a detrimental factor. Also, they are not user-friendly and are a general bother to worry about while out in the field.

Aside from consumer use considerations, humaneness to the hunted game animal is an important consideration as well. When the arrowhead penetrates the animal and the blades begin to rotate open, the more the O-ring is stretched the more resistive force it exerts back against the blades, thus impeding the rate of blade-opening. This can possibly prevent full blade-opening and a quick and humane kill. Also, extreme weather temperatures greatly affect the elasticity of O-rings; cold weather decreases elasticity which increases the likelihood of the blades not opening, and hot weather increases elasticity which increases the likelihood of premature blade opening.

Attempts in the prior art have been made to remedy the problems associated with O-ring use for blade retention of blade-opening arrowheads, but these attempts have their own problems as well. For example, the use of magnetism for blade retention is known to the art. The disadvantages of using magnets for blade retention are that magnets are heavy, relatively expensive, and can demagnetize. The use of a leaf spring for blade retention is also known to the art, where the leaf spring is positioned and held in the blade slot by a set-screw, which is usually also the pivot pin. One disadvantage of using a leaf spring for blade retention is the difficulty involved when replacing the blades; having to simultaneously line up a hole in the leaf spring, a hole in the blade, and a hole in the arrowhead body while inserting a set screw through all three members, for each blade. Another disadvantage of using a leaf spring for blade retention is limitations of the leaf spring, where a very small amount of dirt, debris or ice can prevent the leaf spring from deflecting, and also, the flexibility life span of the leaf spring can be short. This could possibly inhibit blade-opening altogether. Disadvantages of other blade retention methods known to the art are, reduced penetration of the arrowhead, structural weakening of various arrowhead elements, in-operability, and manufactural unfeasibleness.

It is apparent that there are much needed improvements in blade-opening arrowheads, both in consideration of the archery consumer and the hunted game animal.

It is apparent that there is a need for a blade-opening arrowhead that securely holds each blade selectively in a retracted or in-flight position, in a secure or locked manner, by methods other than O-rings or similar consumable elements, that is user-friendly, manufacturally feasible, and structurally strong.

It is also apparent that there is a need for a blade-opening arrowhead that securely holds each blade selectively in a retracted or in-flight position, in a secure or locked manner, that is operable and is not suspectable to malfunctioning by contamination of dirt, debris, or ice and/or by short life span of the blade retention method.

It is yet further apparent that there is a need for a blade-opening arrowhead that is capable of driving the razor cutting edges of the blades from the open position, forwardly into uncut or unpenetrated tissue of an arrowed game animal when the arrow is lodged in the animal, especially when the animal has not been fatally or lethally hit, thus to increase the lethality of the arrowhead, and to be more humane to the animal.

SUMMARY OF THE INVENTION

It is one object of the present invention to provide blade-opening arrowheads with blade retention methods that do not require the use of consumable annular members such as O-rings.

It is another object of the present invention to provide a blade-opening arrowhead that securely holds each blade selectively in a retracted in-flight position, in a secure or locked manner by methods other than O-rings or similar elements, that is user-friendly, manufacturally simple, and structurally strong.

It is another object of the present invention to provide a blade-opening arrowhead that securely holds each blade selectively in a retracted in-flight position, in a secure or locked manner that is operable and is not suspectable to malfunctioning, especially by contamination of dirt, debris, ice and/or by short life span of the blade retention method.

It is another object of the present invention to provide a blade-opening arrowhead that securely holds each blade selectively in a retracted or in-flight position, in a secure or locked manner by releasably latching the blade edge of each blade to the arrowhead body or equivalent. Specifically where an urging force urges the blades in a forward direction to securely hold the edge of each blade engaged against the arrowhead body, and therefore the blades are securely held adjacent to the arrowhead body when in a retracted position but freely rotate into an open position when the arrowhead penetrates an object.

It is still another object of the present invention to provide a blade-opening arrowhead that securely holds each blade selectively in a retracted or in-flight position, in a secure or locked manner by releasably latching the blade edge of each blade to a holding element. Specifically where an urging force urges the holding element to securely hold the edge of each blade engaged against the holding element, and therefore the blades are securely held adjacent to the arrowhead body when in a retracted position but freely rotate into an open position when the arrowhead penetrates an object.

It is yet further another object of the present invention to provide a blade-opening arrowhead that is capable of driving or continually urging the razor cutting edge of each blade from the open position, forwardly into uncut or unpenetrated tissue of an arrowed game animal.

The foregoing objects and advantages and other objects and advantages of the present invention are accomplished with a hunting arrowhead that attaches to the forward end of an arrow shaft, where a plurality of blades are pivotally connected to an arrowhead body. The blades freely rotate from an in-flight retracted position to an open position when the arrowhead penetrates an object, or when acted upon by a sufficient opening force. When the blades are in the in-flight retracted position they are securely held selectively adjacent to the arrowhead body by engagement of a blade edge of each blade to a holding element.

Such a blade-opening arrowhead according to one preferred embodiment of this invention has an arrowhead body with a tip end used for initial penetration and an opposing threaded shaft end that screws or threads the arrowhead to an arrow. The tip end may be removably attached to the arrowhead body, and may be made of material different than the rest of the arrowhead body. The arrowhead body has a plurality of blade slots, one for each respective blade. Each blade has a first end, an opposing second end and an edge extending about its periphery. One blade edge of each blade is sharpened for cutting. The first blade ends or the leading ends each have a protruding wing that is exposed out from the arrowhead body when the blades are in the retracted position. The wings serve to increase the moment-arm for levering or rotating the blades to the open position. The second end of each blade has an aperture or hinge pin receiving hole for receiving a pivot pin or a hinge pin. The arrowhead body also has a hinge pin receiving hole for each blade. The arrowhead body hinge pin receiving holes are recessed or drilled into the two opposing sidewalls of each blade slot, and are threaded to receive the threaded hinge pins. A single hinge pin is used for each blade, and when the blades are positioned in the blade slots, each hinge pin is extended through the aperture of a corresponding blade and is screwed into the arrowhead body. This pivotally connects the blades to the arrowhead body. The cross-sectional area or open area of each blade aperture is greater than the cross-sectional area of its corresponding hinge pin, such that a gap is created between each hinge pin and blade aperture of each blade, when the hinge pins are extended through the blade apertures. These gaps allow each blade to freely move in a forward and rearward direction independent of the arrowhead body and corresponding hinge pin. The blade edge of the first end of each blade has a catch lip or a bump protruding out from it near the cutting edge. The arrowhead body has one receiving notch or holding element formed in it for each blade. The notches are situated near the top of each blade slot and are recessed into the arrowhead body. An annular recess encircling the arrowhead body is situated below the blade slots, and is recessed into the arrowhead body. This annular recess communicates with each blade slot and leaves or defines a stem shaped portion on the arrowhead body. An annular compression spring or coil spring is positioned in the annular recess, with a separate annular ring positioned forward or above the annular spring. Both the annular ring and annular spring are slidably positioned around the stem portion of the arrowhead body, such that the annular ring contacts the second end of each blade. An annular blade-stop washer shaped like a doughnut, also having a recessed portion shaped to contain the annular spring, is slidably positioned around the arrowhead body stem below the annular spring, and contacts the rear end of the annular spring. The blade-stop washer has a sloped outer and upper side, that serves to abut against the blades when they are rotated to the fully open position, thus defining the cutting diameter of the arrowhead when the blades are in the fully open position.

When a blade-opening arrowhead according to the preferred embodiment of this invention as described above, is tightly fastened to the forward end of an arrow shaft, the blade-stop washer is tightened-up against both the arrow shaft and the arrowhead body. This tightening causes the annular spring to be compressed between the blade-stop washer and the annular ring. This compression or biasing of the spring causes an urging force to be exerted against the second ends of the blades in a generally axial direction. The annular ring serves to transfer the urging force equally to all blades. Since a gap exists between each hinge pin and each blade aperture, the urging force moves the blades forward relative to the arrowhead body, and engages or receives the catch lips on the blades into their corresponding receiving notches in the arrowhead body. The continual compression of the annular spring provides a continual urging force which maintains the engagement of the catch lips and notches, thus releasably latching and securely holding the blades selectively in the retracted position. The urging force is strong enough to maintain the blades in the retracted position when the arrow is exposed to incidental forces, such as those produced from transporting the bow, nocking an arrow to the bow string, and acceleration when the arrow is shot. The urging force is weak enough however, to be easily overcome when the arrow impacts or begins to penetrate a game animal.

When the arrowhead according to the above described preferred embodiment initially penetrates an animal, the first ends or leading ends of the blades catch on the animal's surface and the blades are driven rearwards which unlatches the blades. At initial penetration the annular spring is then compressed such that the catch lips are disengaged from the notches sufficiently that the blades lever-out and freely rotate towards the open position. With the blades in the open position, the urging force of the annular spring continually urges the cutting edges of each blade in a forward direction, providing the ability to further cut additional animal tissue, should the arrow still be lodged in the animal.

All that is required to securely lock the blades back in the retracted position, is to simply push each blade back into the retracted position, and the spring compresses as the catch lips are received back into the notches. Once the catch lips are received into the notches, the continual urging force of the spring simply maintains the blades in the retracted position again. Also, when the sharp edges of the blades become dull, all that is required to change the blades is to un-compress the spring by slightly unscrewing the arrowhead from the arrow shaft, and then remove the threaded hinge pin, insert a new blade, and re-insert the hinge pin. There is no requirement to spend additional time and effort lining up tiny holes in other tiny elements such as a leaf spring, with the blade aperture and arrowhead body pivot pin receiving hole, when changing blades or when replacing the spring element or elements.

Blade-opening arrowheads according to other preferred embodiments of this invention differ from the above described preferred embodiment in that they have an annular hinge pin, where the plurality of blades are all attached to the single annular hinge pin. The annular hinge pin is slidably positioned on the stem located near the rear end of the arrowhead body, and is received in the same annular recess as the annular spring and annular ring. According to one such annular hinge pin embodiment, there is substantially no gap between the hinge pin and each blade aperture, and the blades and hinge pin are both urged or moved forward together by the annular spring when the catch lips are received or engaged into the notches. In another annular hinge pin preferred embodiment according to this invention, a gap is formed between the hinge pin and each blade aperture, and the blades are urged or biased by the annular spring when the catch lips are received into the notches.

A blade-opening arrowhead according to another preferred embodiment of this invention, also has an annular recess encircling the arrowhead body, situated below the blade slots, which defines a stem shaped portion on the arrowhead body, and which houses an annular spring and an annular ring. The blade-opening arrowhead according to this preferred embodiment has a catch lip and an adjacent notch in the second end of each blade. Each notch is positioned medial to its corresponding catch lip when the blades are in the retracted position. Each notch is defined by its corresponding catch lip, wherein the notches were created by removal of blade material in fabricating the protruding catch lips. The annular spring urges the annular ring against each catch lip and into each notch, thus engaging the blade edges at the second end of each blade, and securely holding the blades selectively adjacent to the arrowhead body when in the retracted position. The blades are prevented from rotating outwards prematurely by the lateral or outside edge of each blade notch abutting against the lateral surface of the annular ring. When the blade-opening arrowhead according to this preferred embodiment impacts a game animal and the blades begin rotating outwards, the catch lips or lateral edges of the notches are driven into the annular ring, which compresses the annular spring such that the tip of each catch lip slips over the annular ring, thus disengaging the annular ring from the notches and thus allowing the blades to freely rotate towards the open position.

According to another preferred embodiment of this invention, an annular spring is positioned in an annular recess situated near the forward end of the arrowhead body within a separably attachable tip piece. The blade-opening arrowhead according to this preferred embodiment has a catch lip and an adjacent notch in the first end of each blade. Each notch is positioned lateral to its corresponding catch lip when the blades are in the retracted position. Also the notch and catch lip of each blade are situated near the cutting edges of the blades. Each notch is defined by its corresponding catch lip, wherein the notches were created by removal of blade material in fabricating the protruding catch lips. The annular spring urges the annular ring against each catch lip and into each notch in a rearward generally axial direction, thus latching the blade edges and securely holding the blades selectively adjacent to the arrowhead body in the retracted position. The blades are prevented from rotating outwards prematurely by the medial or inside edge of the blade notches abutting against the medial surface of the annular ring. When the arrowhead impacts an animal and the blades begin to rotate outwards, the catch lips are driven into the annular ring, which forces the annular spring to compress until the catch lips freely slip under the annular ring. In this manner the blades are unlatched and freely rotate towards the open position.

The blade-opening arrowheads according to this invention, use no consumable items such as O-rings, for blade retention. The blade retention methods of the blade-opening arrowheads according to this invention, are simple and user-friendly. The blade-opening arrowheads according to this invention provide blade retention methods that are not suspectable to malfunctioning when exposed to the harsh conditions commonly encountered in the field, and when subjected to prolonged use. Should ice, dirt or debris get intermingled with the annular spring of the type preferred for use according to this invention, the annular spring will still serve to produce an effective blade retention urging force, and to allow the timely opening of the blades at target impact. This is so because the spaces between the spring coil wires are large enough to handle a relatively large accumulation of foreign matter, yet have room to allow adequate spring compressing. Also, the length of spring flexibility life of the annular spring according to this invention, under normal use considerations, is indefinite. This is such because the diameter or gauge of the wire, and the general diameter of the spring are large enough that the annular spring is extremely rugged and durable in nature, especially when compared to the relatively light work load required of it.

The blade-opening arrowheads according to this invention are also more humane, and more lethal than prior art arrowheads. Should the arrow become lodged in the game animal, particularly when the animal has not been fatally hit, the blades will be driven or continually urged in a forward direction by the urging force of the annular spring, cutting additional tissue, which could possibly sever any nearby arteries or vital organs, and thus decrease the wounding loss. This trait of cutting additional tissue is a feature that no prior arrowhead performs. The blade-opening arrowheads, according to this invention are also structurally strong, simple and feasible to manufacture, and operable.

As has been shown in the above discussion, the blade-opening arrowheads according to this invention overcome deficiencies inherent in prior art arrowheads.

With the above objects and advantages in view, other objects and advantages of the invention will more readily appear as the nature of the invention is better understood, the invention is comprised in the novel construction, combination and assembly of parts hereinafter more fully described, illustrated, and claimed.

Figure 1:
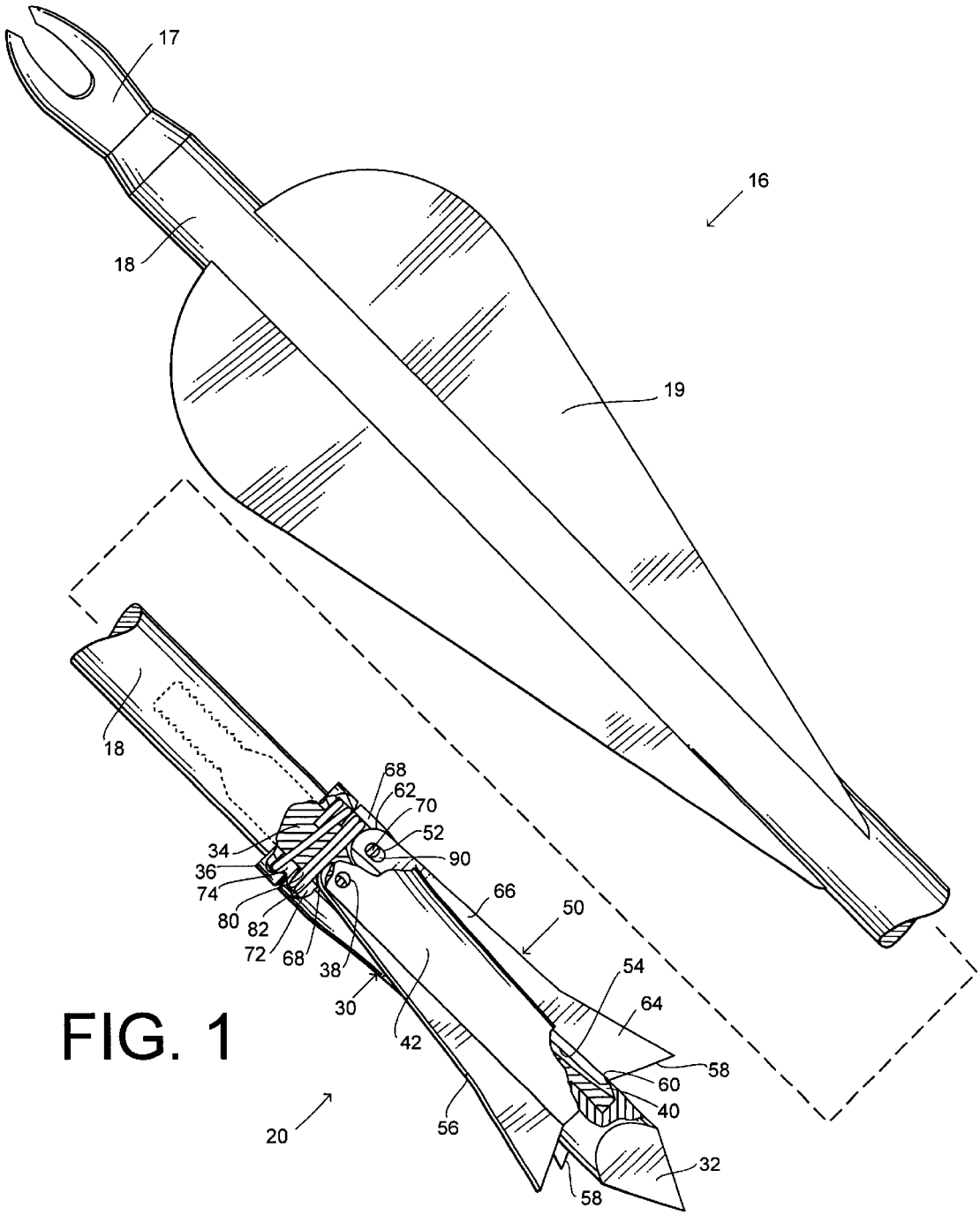
FIG. 1 is perspective view of an arrow with a blade-opening arrowhead according to one preferred embodiment of this invention attached to the forward end of the arrow shaft, with the blades in the retracted position.

| REFERENCE NUMERALS IN DRAWINGS | |
|---|---|
| 16 | arrow |
| 17 | nock |
| 18 | arrow shaft |
| 19 | fletching |
| 20 | blade-opening arrowhead |
| 21 | blade-opening arrowhead |
| 22 | blade-opening arrowhead |
| 23 | blade-opening arrowhead |
| 24 | blade-opening arrowhead |

-continued

| REFERENCE NUMERALS IN DRAWINGS | |
|---|---|
| 25 | blade-opening arrowhead |
| 26 | blade-opening arrowhead |
| 27 | blade-opening arrowhead |
| 28 | blade-opening arrowhead |
| 30 | arrowhead body |
| 32 | tip |
| 34 | stem |
| 36 | blade-stop washer |
| 38 | hinge pin receiving hole, arrowhead body |
| 40 | notch, arrowhead body |
| 42 | sidewall of arrowhead body |
| 44 | notch, blade |
| 46 | second notch, blade |
| 50 | blade |
| 52 | aperture |
| 54 | inner edge, cutting edge |
| 56 | outer edge |
| 58 | distal edge |
| 60 | catch lip |
| 62 | proximal edge |
| 64 | wing |
| 66 | side of blade |
| 68 | blade slot |
| 70 | hinge pin |
| 72 | annular recess, arrowhead body |
| 74 | annular recess, blade-stop washer |
| 76 | annular recess, tip |
| 78 | abutting shoulder, arrowhead body |
| 80 | annular spring |
| 82 | annular ring |
| 84 | annular hinge pin |
| 90 | gap |
| 100 | opening force |

DETAILED DESCRIPTION OF THE PREFERRED EMBODIMENTS

Figure 2:
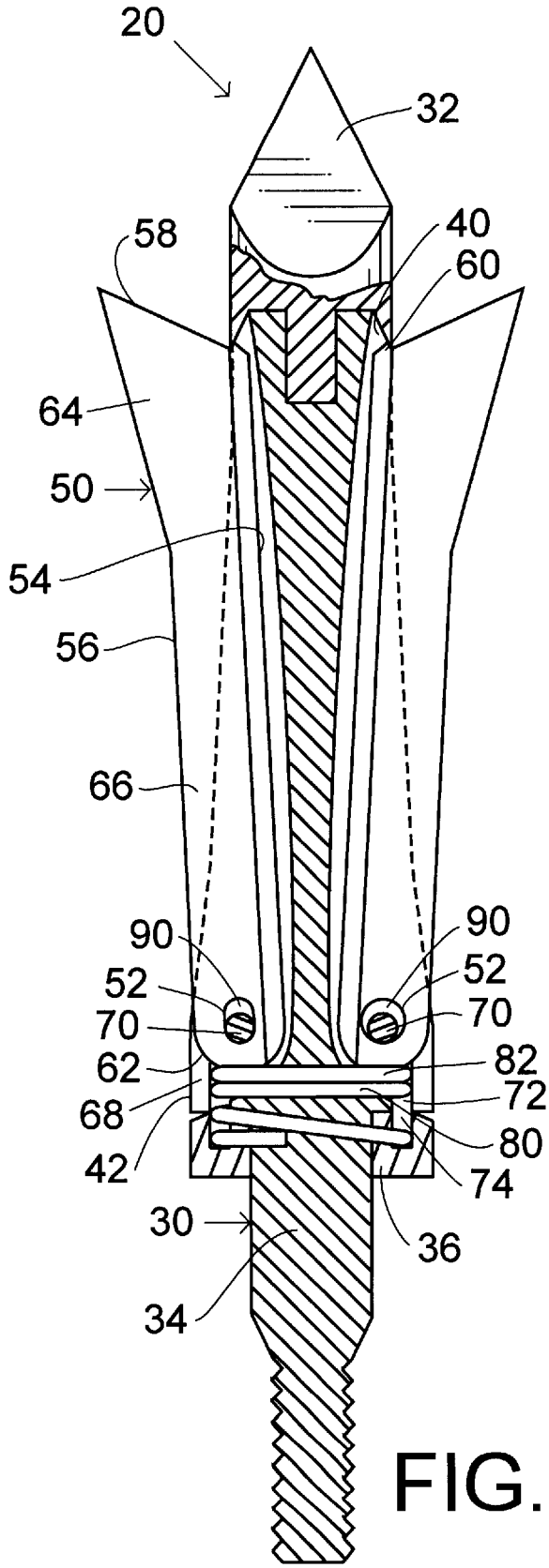
FIG. 2 is a full length longitudinal cross-section of the preferred embodiment as illustrated in FIG. 1, but showing a plurality of two blades pivotally connected to the arrowhead body, with the blades in the retracted position. The annular ring and annular spring are shown in perspective view.
Figure 3:
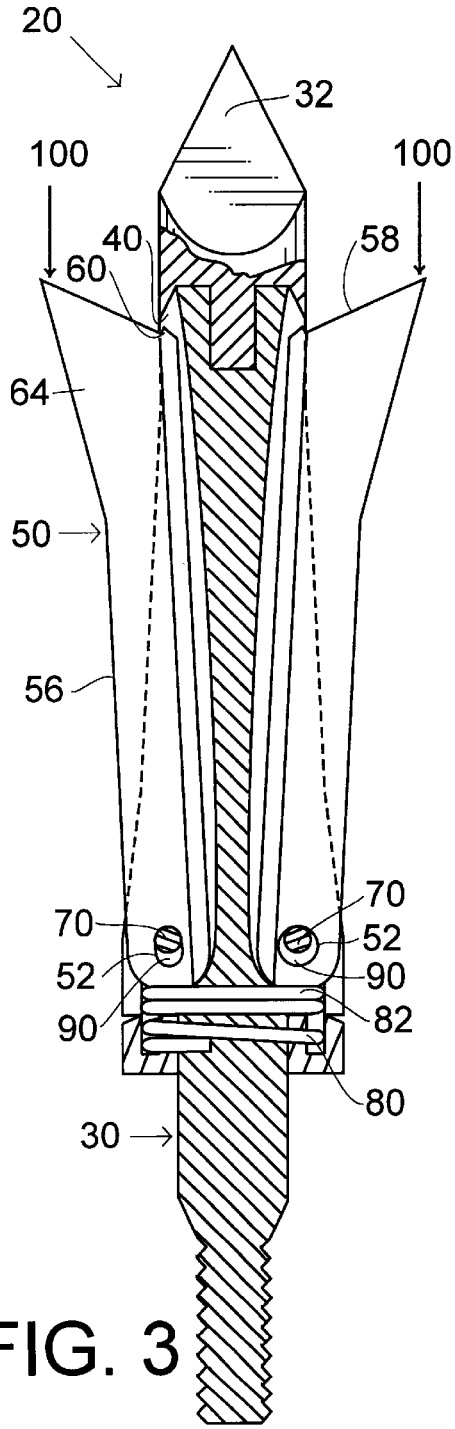
FIG. 3 is a full length longitudinal cross-section of a blade-opening arrowhead as illustrated in FIG. 2, showing initial rearward blade displacement occurring at initial penetration of an object.
Figure 4:
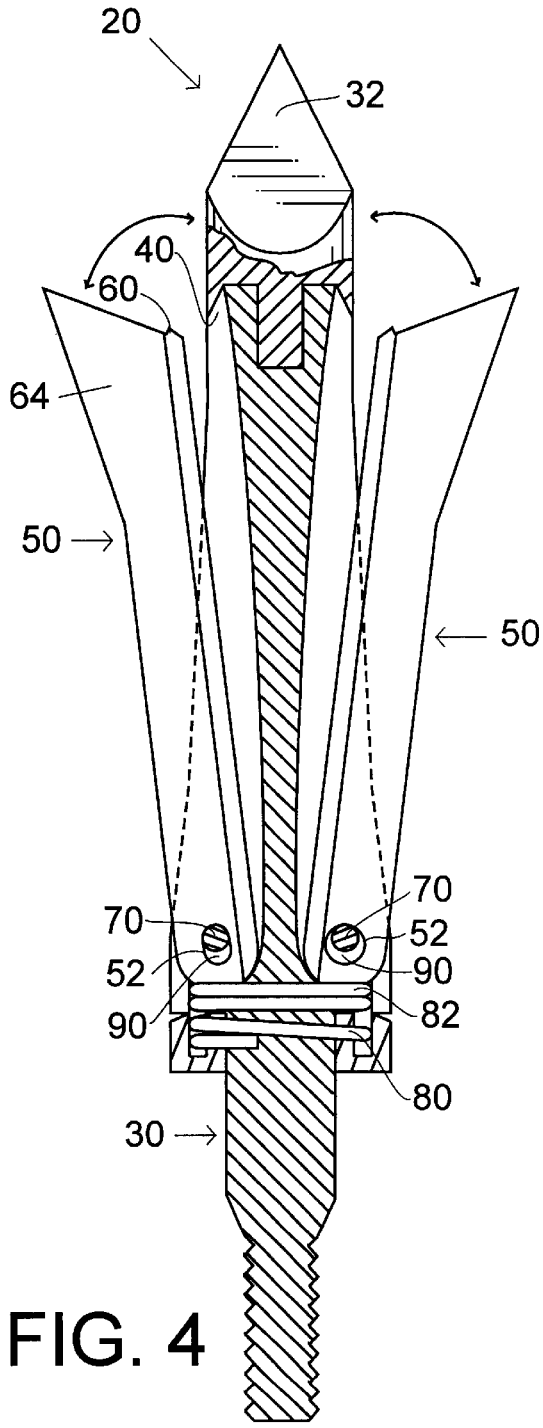
FIG. 4 is a full length longitudinal cross-section of a blade-opening arrowhead as illustrated in FIG. 2, showing the blades rotating away from the arrowhead body after initial penetration of an object.
Figure 5:
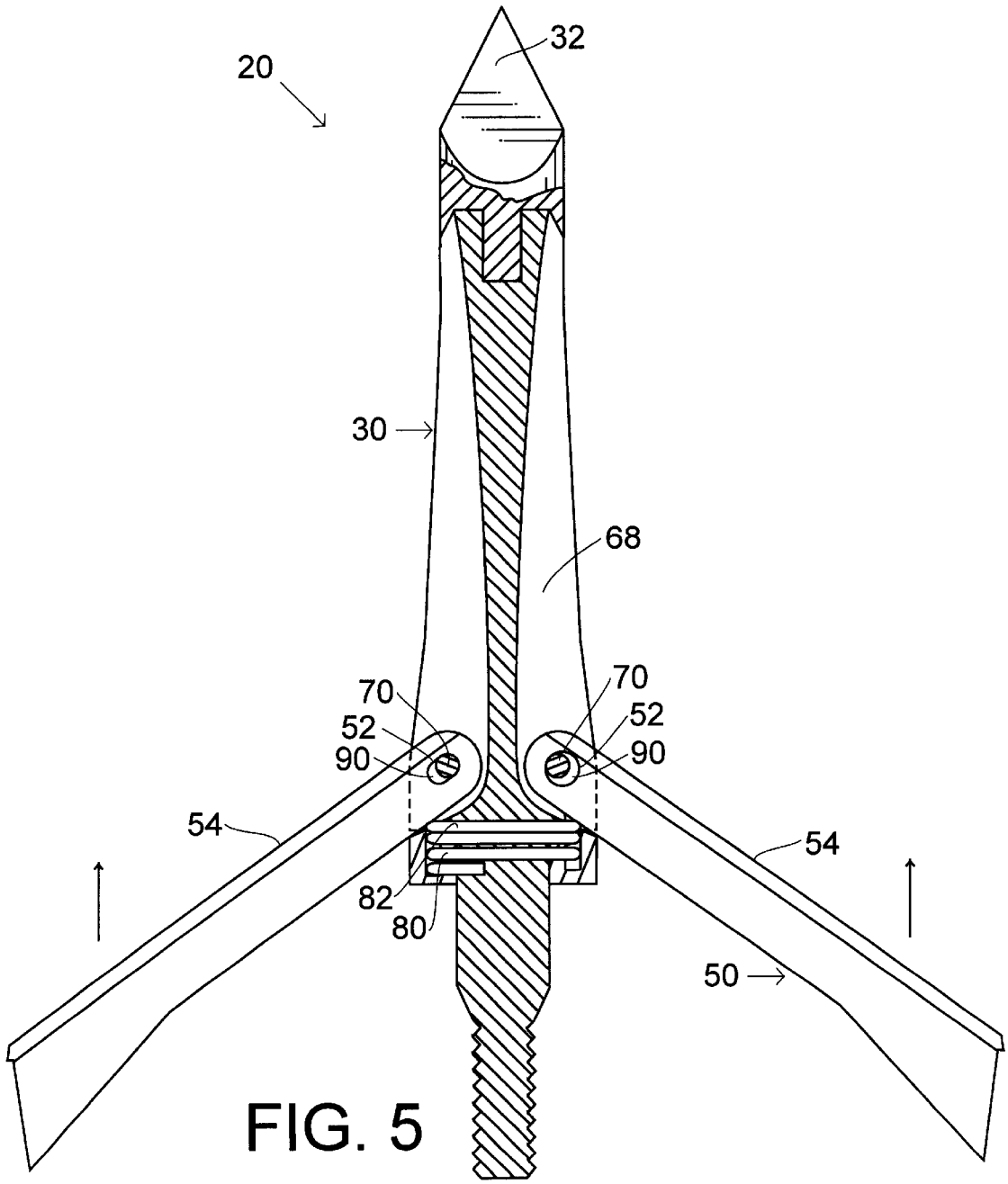
FIG. 5 is a full length longitudinal cross-section of a blade-opening arrowhead as illustrated in FIG. 2, showing the blades in the fully open position with the annular spring continually urging the blades forward.

FIGS. 1–6 illustrate a preferred embodiment according to this invention wherein FIG. 1 shows a conventional arrow 16, having a nock 17 for receiving a bow string, an arrow shaft 18, stabilizing fletchings 19, and a blade-opening arrowhead 20 attached to the forward end of the arrow shaft 18. The stabilizing fletchings 19 are helically mounted on the arrow shaft 18, which causes the arrow 16 to spiral or rotate in flight, which greatly enhances accuracy. Blade-opening arrowhead 20, in FIG. 1, shows a plurality of three blades 50 pivotally connected to an arrowhead body 30, each by a hinge pin 70 that is threaded or screwed into a corresponding threaded hinge pin receiving hole 38 in arrowhead body 30. Hinge pin receiving hole 38 passes through the opposing sidewalls of a corresponding blade slot 68, for each blade 50. An aperture 52 in one opposing end of each blade 50 has hinge pin 70 extending therethrough, when blades 50 are pivotally connected to arrowhead body 30. Each blade 50 rotates between a retracted position where the edges of blades 50 are engaged and releasably latched to holding means, as shown in FIGS. 1 and 2, and an open position as shown in FIG. 5 where the other opposing blade end of each blade 50 is rotated away from arrowhead body 30. A gap 90 is formed between each hinge pin 70 and aperture 52, such that each blade 50 is free to move relative to corresponding hinge pin 70 and arrowhead body 30. Hinge means connect each blade 50 to arrowhead body 30.

Hinge means, according to this invention, are intended to comprise any suitable element or elements that serve to pivotally connect each blade 50 to arrowhead body 30. As shown in FIGS. 1–8 and 13–15 according to some preferred embodiments of this invention, straight hinge pins 70 are received in apertures 52 located near a second blade end or a proximal blade edge 62, of each corresponding blade 50. As shown in FIGS. 9–12 according to other preferred embodiments of this invention, annular hinge pin 84 is received in apertures 52 of a corresponding plurality of blades 50, near the second end of each blade or proximal blade edges 62. Any shape of aperture 52 and any pin 70, 84, received therein will suffice for hinge means. Hinge means may comprise rod or bar stock, bearing members such as a ball bearing, and protrusions or bumps machined or formed into the arrowhead bodies 30, and the like, and may be straight or curved such as annularly, and may accommodate, have connected thereto or have received thereon a plurality of blades 50, or a single individual blade 50. The hinge means according to this invention may attach to the arrowhead body 30 slidably, or be screwed or threaded on. It is apparent that apertures 52 may not communicate with the peripheral edges of blades 50 thereabout, thus creating a through hole, or that apertures 52 may communicate with the peripheral edges of blades 50.

Referring to FIGS. 1–6, wherein FIG. 2 shows a blade-opening arrowhead 20, identical to blade-opening arrowhead 20 as illustrated in FIG. 1, but for reasons of clarity having only two blades 50, which are superimposed upon a longitudinal cross-section or cutaway of arrowhead body 30. Each blade 50 has a pair of blade sides 66, and is positioned in a respective blade slot 68 that communicates with an outer sidewall 42 of arrowhead body 30. An annular spring 80 and an annular ring 82 shown in perspective view in FIG. 2, are positioned slidably about a stem 34 of arrowhead body 30. Annular spring 80 and annular ring 82 are positioned in an annular recess 74 of a blade-stop washer 36 and an annular recess 72 of arrowhead body 30. Both annular recesses 72, 74 encircle about the longitudinal axis of blade-opening arrowhead 20. Each blade 50 when in the retracted position has an inner edge 54 extending generally longitudinally between opposing blade ends, and an outer edge 56 extending generally longitudinally between opposing blade ends. Also, a distal edge 58 extends between inner edge 54 and outer edge 56 at the first end or leading ends of blades 50, and a proximal edge 62 extends between inner edge 54 and outer edge 56, at the second end or hinge connecting ends of blades 50.

Blade-stop means, such as blade-stop washer 36, according to this invention, serve to abut outer edge 56 of each blade 50 when blades 50 are in the fully open position as illustrated in FIG. 5, thus defining the cutting diameter of arrowhead 20. Blade-stop means according to this invention comprise any element that serves to abut against blades 50, thus stopping their opening rotation. It is apparent that outer blade edges 56 may abut arrowhead body 30 or an equivalent, to lessen the impact forces transferred to the hinge means.

Selectively retaining blades 50 in a retracted or in-flight position according to this invention is intended to mean that the position blades 50 are placed in is selectable, or that blades 50 can be positioned in more than one position. Preferably selectable blade positions according to this invention are the retracted position and the open position. Blades 50 are securely held in the retracted position or in a first selectable position in a locked manner until acted upon by an opening force 100, whereupon they freely rotate to the open position, or a second selectable position.

Figure 6:
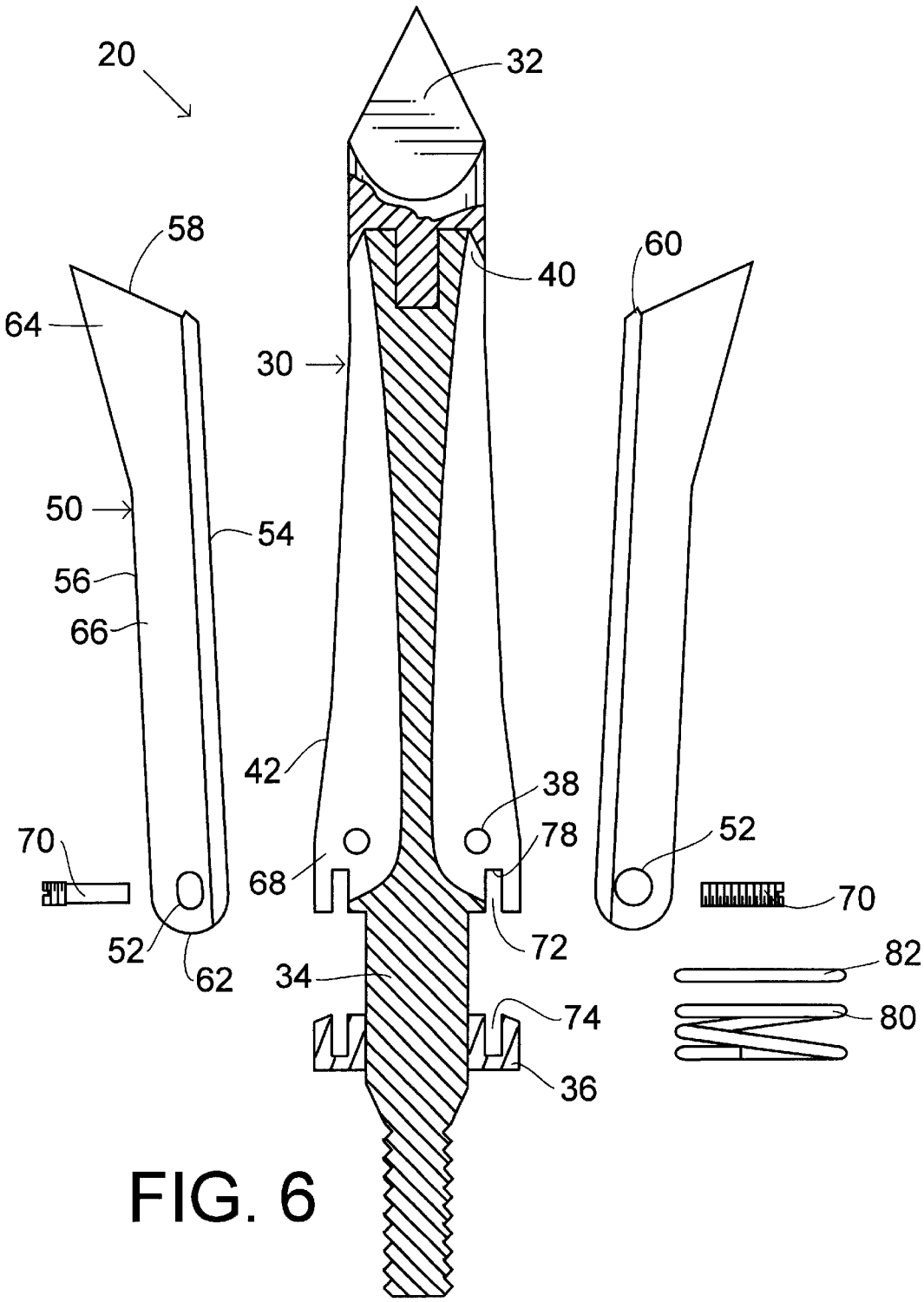
FIG. 6 is an exploded full length longitudinal cross-section of a blade-opening arrowhead as illustrated in FIG. 2. The hinge pins, annular ring, annular spring and blades are shown in perspective.

According to the preferred embodiment illustrated in FIGS. 1–6, annular ring 82 is biased into or against proximal edges 62 of each blade 50 when annular spring 80 is compressed. When arrowhead 20 is tightly fastened to arrow shaft 18, blade stop washer 36 is snugged up to both arrowhead body 30 and to arrow shaft 18. This compresses annular spring 80 such that annular spring 80 biases annular ring 82 into blades 50. The forward displacement of annular ring 82 and annular spring 80 is limited by an abutting shoulder 78, as shown in FIG. 6. This biasing or compressing of annular spring 80 produces an urging force which urges blades 50 in a forward direction such that a catch lip 60 on distal blade edge 58 of each blade 50 is received or engaged in a corresponding receiving notch 40. Notches 40 are recessed into arrowhead body 30 near the forward end of each corresponding blade slot 68. When catch lips 60 are received into notches 40 the edges of blades 50 are releasably latched and engaged such that blades 50 are securely held selectively adjacent to arrowhead body 30 in the retracted position. When arrow 16 having blades 50 in the retracted position, as shown in FIG. 1, is shot and impacts an animal or an object, and begins initial penetration, as shown in FIG. 3, a wing 64 projecting out from blade edges 56 and 58 of each blade, catches on the animal's surface and opening force 100 drives blades 50 rearwardly. As is clearly shown in FIG. 3 at initial penetration or impact, annular spring 80 is compressed, such that gaps 90 are below hinge pins 70, and catch lips 60 are effectively disengaged from notches 40 so that blades 50 are unlatched. As shown in FIG. 4, while penetrating the animal or object after initial impact, blades 50 begin to rotate away from arrowhead body 30, towards the fully open position. As illustrated in FIG. 5, when blades 50 are in the open position the continual urging force produced by annular spring 80 drives or continually urges cutting edge 54 of each blade 50 in a forward direction, further slicing uncut or unpenetrated tissue. When arrowhead 20 is pulled-out from a target or a game animal blades 50 rotate from the fully open position to a non-barbing position as clearly shown in FIG. 4, wherein the angle between blade edges 56 of each blade and a point rearward of hinge pins 70 on arrow shaft 18 is greater than ninety degrees. It is apparent that wing 64 can be positioned at different locations along blade edge 56 of each blade 50, specifically to create an open-after impact blade-opening arrowhead, as is known to the art.

Bias means according to this invention, comprise any element or elements that produce an urging force. Bias means according to this invention can comprise, but not be limited to, any resilient, compressible, deflectable, flexible, or stretchable mechanical member or members and the like, which have the ability to substantially return to their original state, such that an urging force is generated in a direction substantially opposite the direction the bias element or bias means is deformed. Bias means may include a single bias element urging a plurality of blades, or may be an individual bias element for each blade, or a combination thereof. Bias means for example, can include, cantilevers, rubber material, certain hydraulic systems and/or filled bladder systems, and springs such as compression, coil or leaf. The bias means can be fabricated of metal, plastics or composites. In the preferred embodiments according to this invention, bias means produce an urging force which is preferably strong enough to securely hold the pivotal blades 50 retained in the retracted position when exposed to incidental forces, but yet is weak enough to be quickly and immediately overcome when penetrating an object, such that razor cutting edges 54 are timely exposed, and the penetrated object is maximumly cut. According to this invention compressible annular spring 80 mounted on arrowhead body 30 to bias against the edges of blades 50 when blades 50 are in the retracted position, may include or mean that annular spring is biasing an element into the edges of blades 50 other than itself, such as annular ring 82.

Means for continually urging cutting edges 54 of the blades 50 forward when in the open position may comprise the bias means according to this invention.

Figure 7:
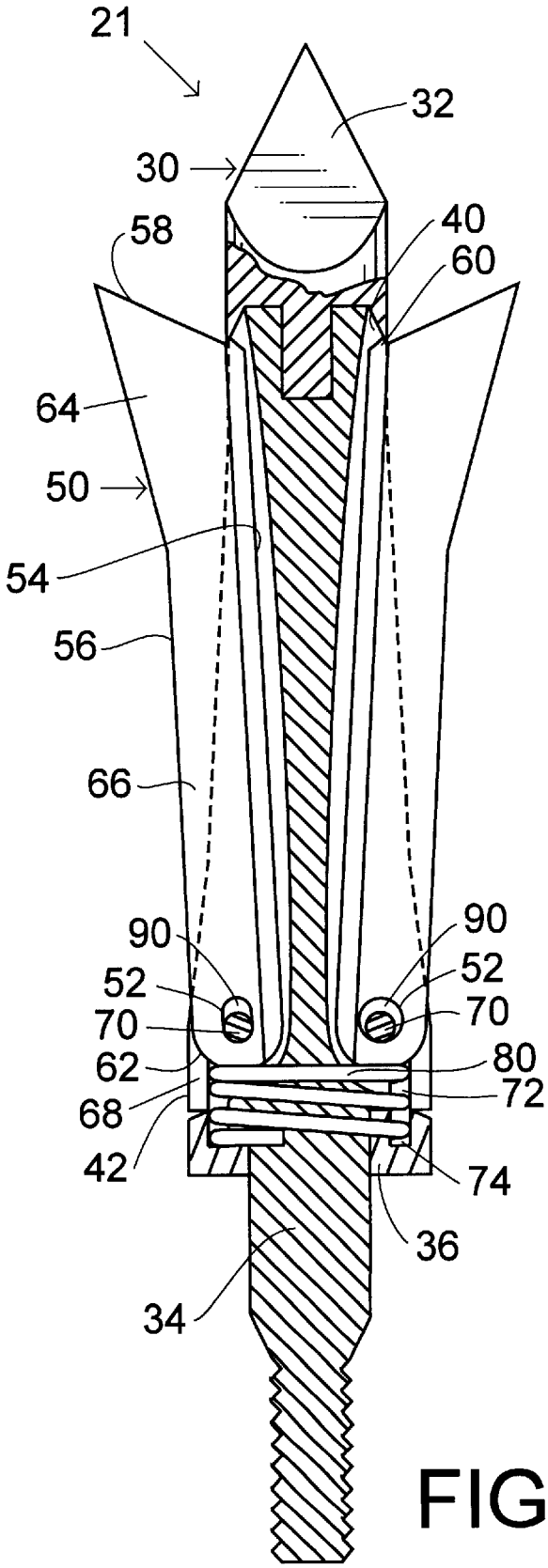
FIG. 7 is a full length longitudinal cross-section of a blade-opening arrowhead according to another preferred embodiment of this invention, similar to the preferred embodiment shown in FIG. 2, but without an annular ring.

FIG. 7 illustrates blade-opening arrowhead 21, another preferred embodiment according to this invention. Blade-opening arrowhead 21 is similar to blade opening arrowhead 20 except annular ring 82 is omitted. It is apparent that the operation of blade retention according to the scope of this invention is attainable without use of annular rings or equivalents, such as annular ring 82.

Figure 8:
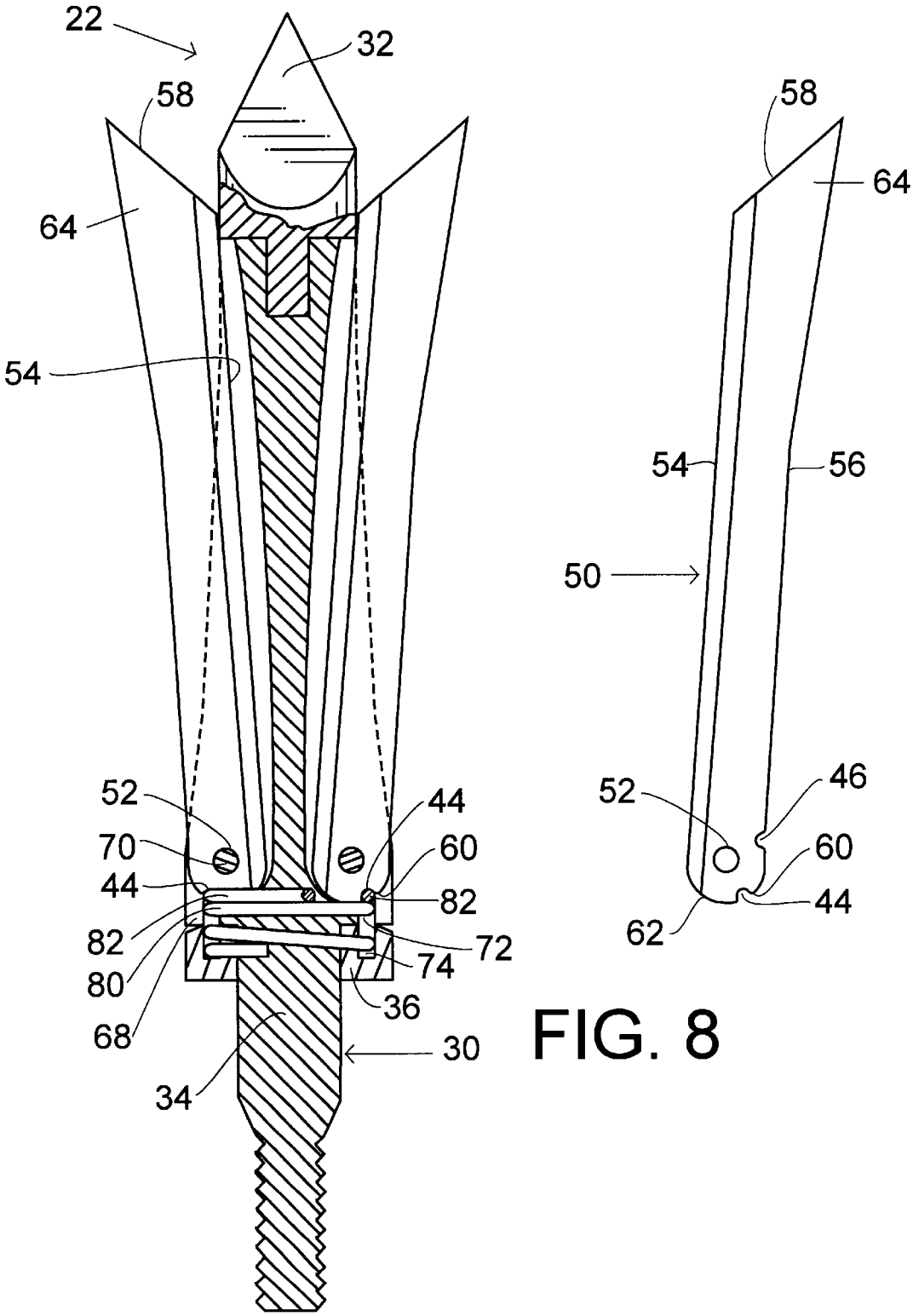
FIG. 8 is a full length longitudinal cross-section of a blade-opening arrowhead according to another preferred embodiment of this invention, showing the annular spring urging the annular ring into a notch in each blade. The hinge pins, annular ring, annular spring and blades are shown in perspective. An additional detached blade is shown also.

FIG. 8 illustrates blade-opening arrowhead 22, another preferred embodiment according to this invention which is similar to blade-opening arrowheads 20 and 21, except blade-opening arrowhead 22 has no receiving notches in arrowhead body 30, but rather has a notch 44 and adjacent catch lip 60 in proximal edges 62 of each blade 50. As is clearly illustrated in FIG. 8, when blades 50 are in the retracted position catch lips 60 are positioned immediately lateral of notches 44. To securely hold blades 50 of arrowhead 22 selectively adjacent to arrowhead body 30 in the retracted position, the urging force produced by annular spring 80 urges annular ring 82 into notches 44 and against catch lips 60 of each blade 50. This engages each edge of blades 50 to annular ring 82, which prevents blades 50 from rotating towards the open position prematurely or until acted upon by a sufficient opening force 100. When arrowhead 22 is shot and impacts an animal, and begins initial penetration, wings 64 projecting out from blade edges 56 and 58 of each blade, catch on the animal's surface and opening force 100 drives blades 50 rearwardly, thus disengaging blade edges 62 and allowing blades 50 to freely rotate to the open position. It is apparent that another notch 46 can be situated in outer edge 56 of each blade near apertures 52, such that when blades 50 are in the fully open position annular ring 82 is matingly received or engaged in such other notches. It is also apparent that annular ring 82 or annular spring 80 can contact blade edges 62 of each blade, medially of, in line with, or lateral of, the cross-sectional center of corresponding hinge pins 70. According to this invention catch lips 60 of each blade 50 comprise a protruding point or tip and inclined sides, so that when annular spring 80 urges annular ring 82 against catch lips 60 of each blade 50 or when annular spring 80 is biased against catch lips 60, the sides of catch lips 60 are contacting the bias means and/or holding means.

Holding means according to this invention comprise any surface or surfaces, whether integral with, or separably attachable from, arrowhead body 30, which are capable of being in contact with a specific area or areas of the edge of each blade, to engage with such blade edge areas such that blades 50 are securely held selectively adjacent to arrowhead body 30 when blades 50 are in the retracted position. Holding means according to this invention may also comprise the blade edge or specific areas of the blade edge, in addition to the surfaces that contact the blade edges as discussed above. For example, holding means may comprise catch lips 60 and notches 40.

According to the preferred embodiments of this invention retaining means comprise bias means and holding means, where an urging force produced from the bias means engages the holding means to the edge of each blade 50, such that each blade 50 is securely held selectively adjacent to arrowhead body 30 when in the retracted position.

According to this invention engagement, or engaging and disengaging, of a blade edge to holding means has the intended meaning that when blades 50 are held in the retracted position the engaging areas of the blade edges are engaged with the holding means such that they are in contiguous or intimate contact with the holding means, and then when blades 50 are acted upon by a sufficient opening force 100 the specific engaging areas of the blade edges are disengaged such that they are no longer in contiguous or intimate contact with the holding means.

Releasably latching, or latching and unlatching, of a blade edge to holding means according to this invention, as used throughout this specification and in the claims, has the intended meaning that substantially no part of the blade edge of each blade is in contact with the holding means after disengagement of the holding means from the specific blade edge engaging area or areas. Contrastingly, O-rings and the like, remain in contact with the blade edges for a significant portion of the blade rotation while the blades are rotating towards the open position, wherein the more the blades rotate towards the open position the more the O-ring is stretched and further stretched, thus impeding the rate of blade opening, until the O-ring is sheared or rolls back.

According to the preferred embodiments of this invention the blade edges are engaged and disengaged to holding means. According to some preferred embodiments of this invention the blade edges are also releasably latched in addition to being engaged and disengaged, whereas in other preferred embodiments of this invention the blade edges are not releasably latched when the blades edges are engaged and disengaged. It is apparent that engaging and disengaging, and releasably latching according to this invention can be interchanged, and/or combined amongst the preferred embodiments of this invention in various different arrangements, without deterring from the scope of the invention.

In the preferred embodiment of this invention as illustrated in FIG. 8, retaining means comprise holding means and bias means, where bias means urge holding means into notches 44 and against catch lips 60 of edges 62 of each blade 50, to securely hold edges 62 of blades 50 engaged against the holding means. Particularly, the holding means comprises annular ring 82, and the bias means comprises annular spring 80 which urges annular ring 82 into notches 44 of each blade 50.

Retaining means according to the preferred embodiments of this invention as illustrated in FIGS. 1–7 and 9–15, releasably latch the edge of each blade 50 such that blades 50 are selectively held in a retracted position until penetrating an object or when subjected to opening force 100, whereupon blades 50 are unlatched, and freely rotate towards the fully open position.

According to the preferred embodiments of this invention as illustrated in FIGS. 1–7, and 9–12, retaining means comprise holding means and bias means, where the bias means urge blades 50 into the holding means, to securely hold the edges of blades 50 engaged and latched against the holding means. Particularly, the holding means comprises receiving notches 40 and the bias means comprises annular spring 80 which urges catch lips 60 into notches 40.

Figure 13:
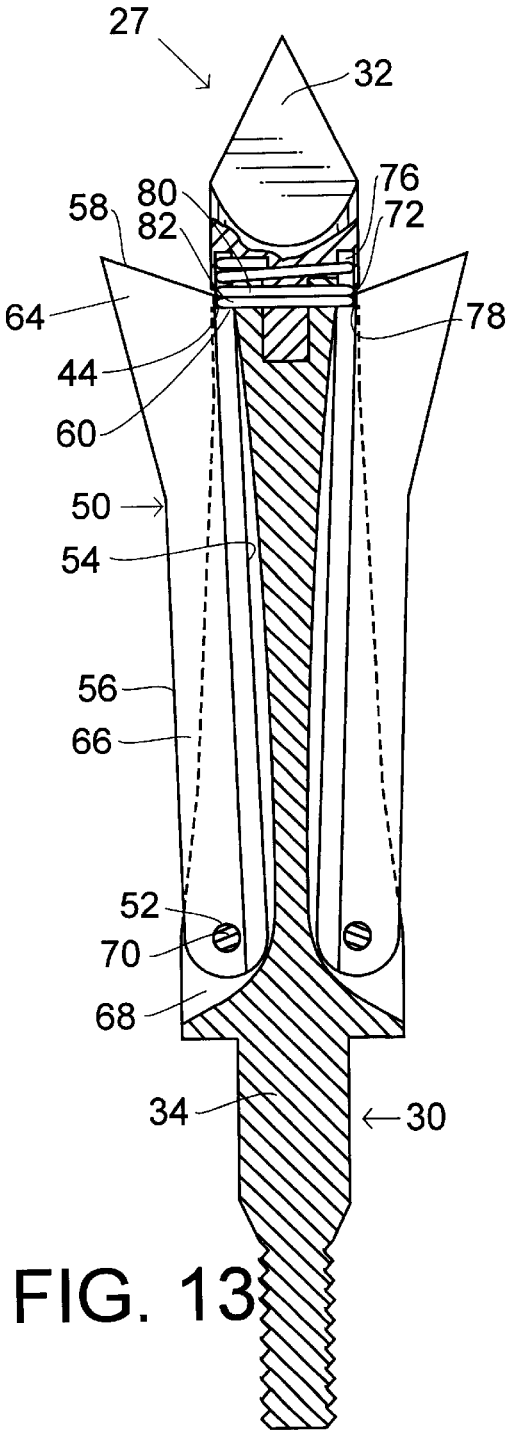
FIG. 13 is a full length longitudinal cross-section of a blade-opening arrowhead according to another preferred embodiment of this invention, showing a plurality of blades pivotally connected to the arrowhead body, with the blades in the retracted position. The annular ring and annular spring are shown in perspective.
Figure 14:
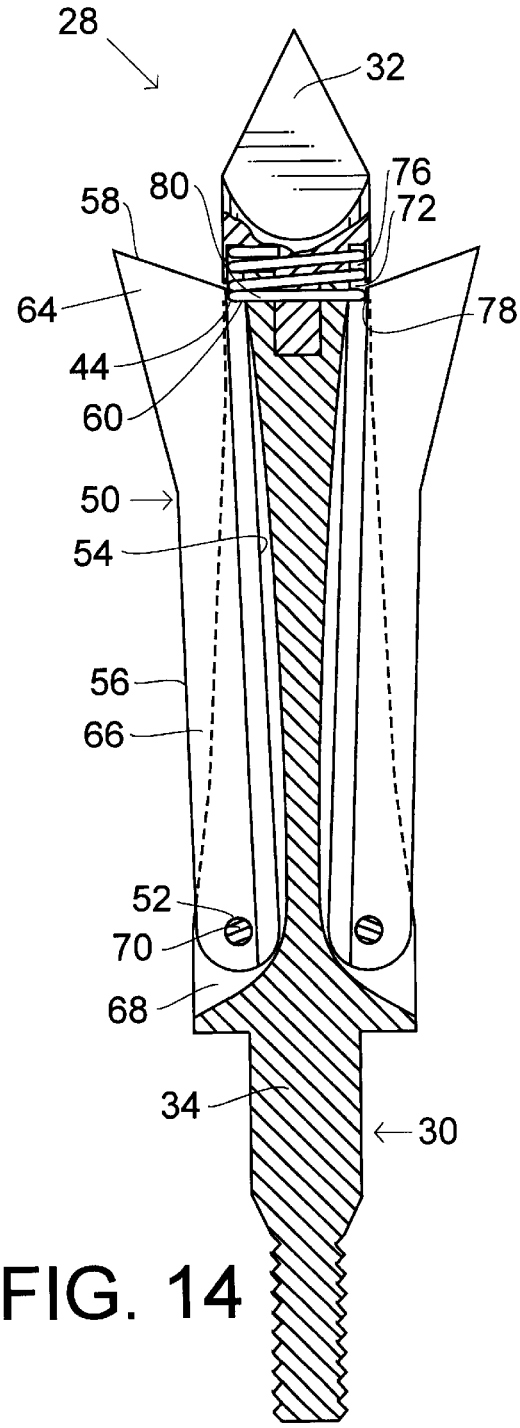
FIG. 14 is a full length longitudinal cross-section of a blade-opening arrowhead according another preferred embodiment of this invention, similar to the preferred embodiment shown in FIG. 13, showing a plurality of blades pivotally connected to the arrowhead body, with the blades in the retracted position, but without an annular ring.
Figure 15:
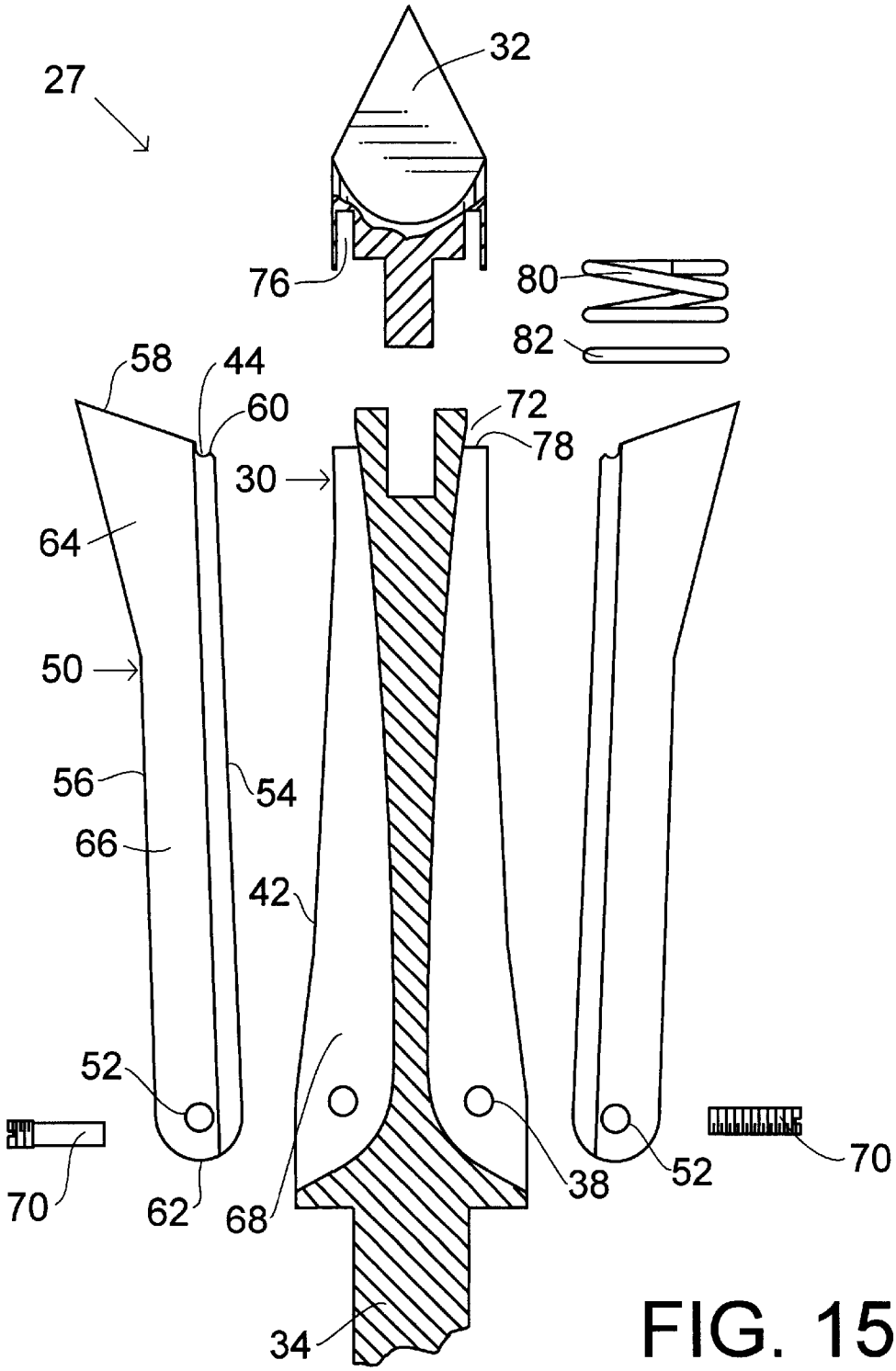
FIG. 15 is an exploded full length longitudinal cross-section of a blade-opening arrowhead as illustrated in FIG. 13. The hinge pins, annular ring, annular spring and blades are shown in perspective.

In the preferred embodiments of this invention as illustrated FIGS. 13–15, retaining means comprise holding means and bias means, where bias means urge holding means into and against edges 58 of each blade 50, to securely hold edges 58 of blades 50 engaged and latched against the holding means. Particularly, the holding means comprises annular ring 82, and the bias means comprises annular spring 80 which urges annular ring 82 into notches 44 of each blade 50.

FIGS. 13 and 15 illustrate a blade-opening arrowhead 27 according to another preferred embodiment of this invention, where annular spring 80 and annular ring 82 are housed in an annular recess 76 situated within removably attachable tip piece 32, and annular recess 72 which is positioned near the forward end of arrowhead body 30. Particularly, according to blade-opening arrowhead 27 bias means comprises compressible annular spring 80 biasing annular ring 82 against distal edge 58 of each blade 50, and holding means comprises annular ring 82. Blade-opening arrowhead 27 has substantially no gap between apertures 52 and hinge pins 70.

FIG. 14 illustrates a blade-opening arrowhead 28 according to another preferred embodiment of this invention, similar to arrowhead 27, except without an annular ring. Particularly, according to blade-opening arrowhead 28 as shown in FIG. 14, bias means comprises compressible annular spring 80 biased against distal edge 58, of the first end of each blade 50, and holding means also comprises annular spring 80. Accordingly, holding means comprises bias means. When annular spring 80 is urged into notches 44 and against catch lips 60 of distal edge 58 of each blade 50, blades 50 are engaged and latched in the retracted position.

FIGS. 9–12 illustrate blade-opening arrowheads 23–26 according to this invention, which are similar to blade-opening arrowheads 20 and 21 as illustrated in FIGS. 1–7, except annular hinge pin 84 receives the plurality of blades 50 for each arrowhead 23–26. Annular hinge pin 84 is slidably positioned in annular recess 72 around stem 34 of arrowhead body 30.

Figure 9:
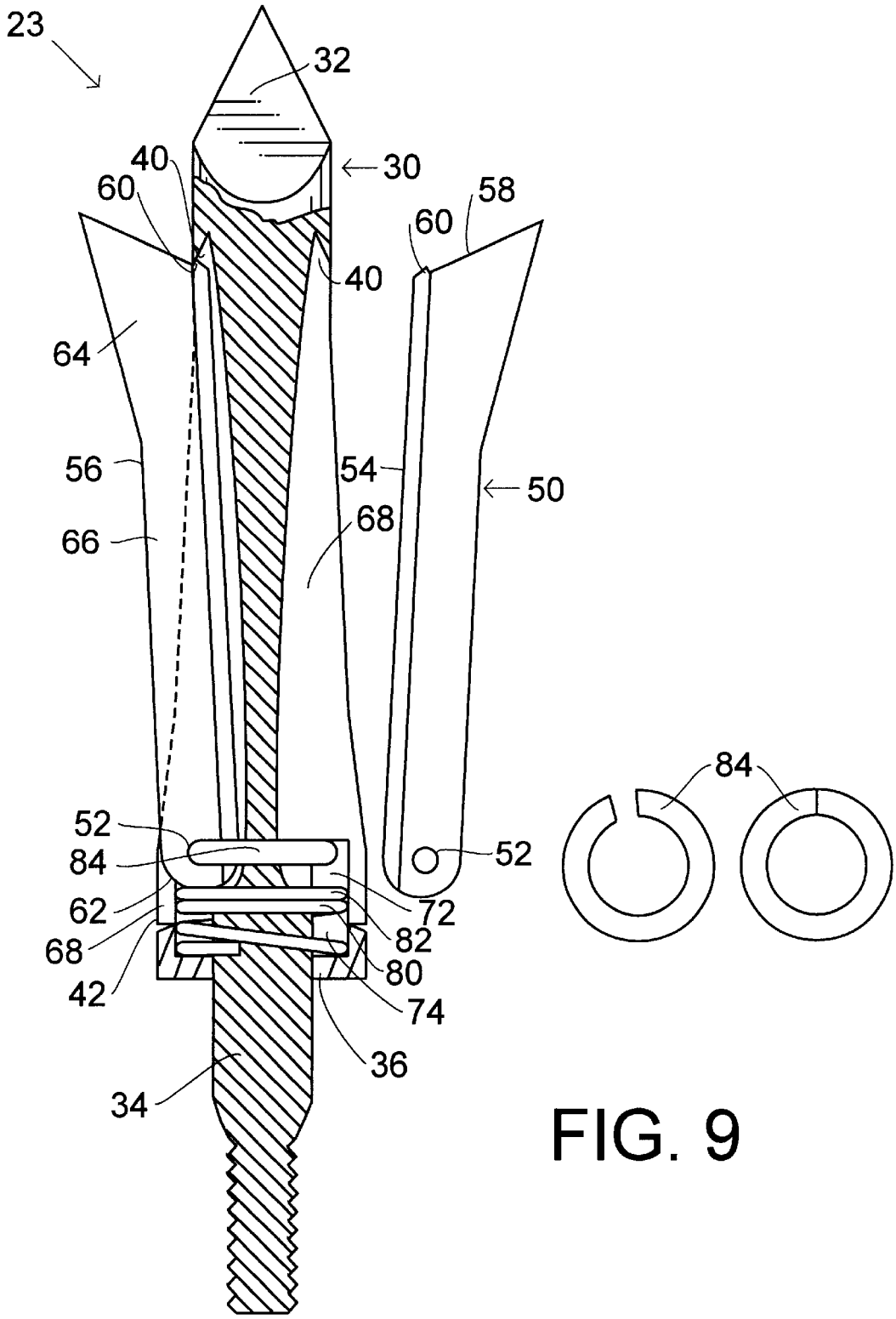
FIG. 9 is a full length longitudinal cross-section of a blade-opening arrowhead according to another preferred embodiment of this invention, showing an annular hinge pin slidably positioned on the arrowhead body, with substantially no gap between the blade apertures and annular hinge pin. The annular hinge pin is shown in a top view also.
Figure 10:
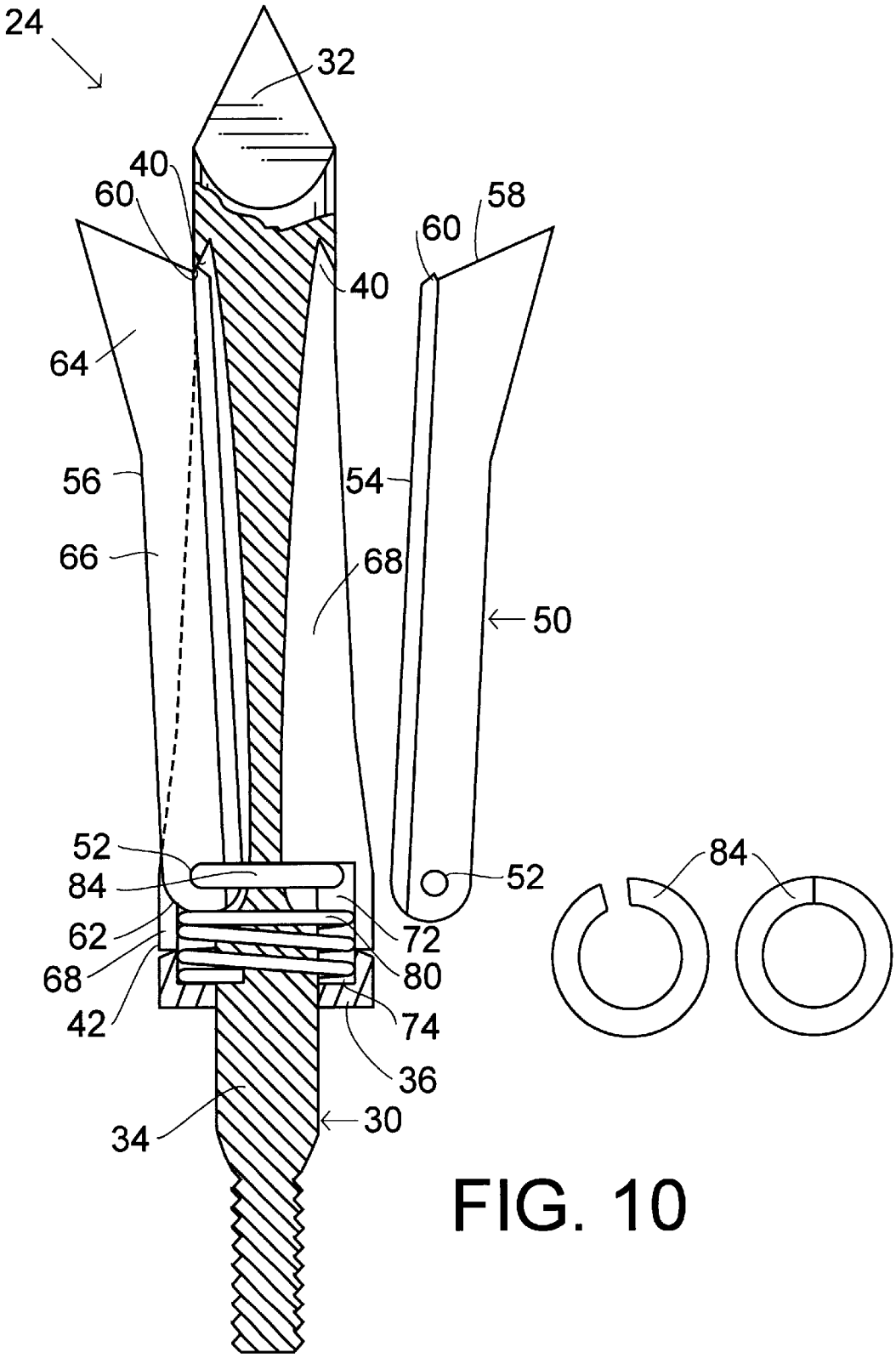
FIG. 10 is a full length longitudinal cross-section of a blade-opening arrowhead similar to the blade-opening arrowhead illustrated in FIG. 9, but without an annular ring. The annular hinge pin is shown in a top view also.

FIGS. 9 and 10 illustrate blade-opening arrowheads 23 and 24 which have substantially no gap between apertures 52 of blades 50 and annular hinge pin 84, wherein both the plurality of blades 50 and annular hinge pin 84 are urged together when engaging or receiving catch lips 60 into notches 40. Particularly, blade-opening arrowhead 23 uses annular ring 82 to equally distribute the urging force to all blades 50, whereas blade-opening arrowhead 24 does not.

Figure 11:
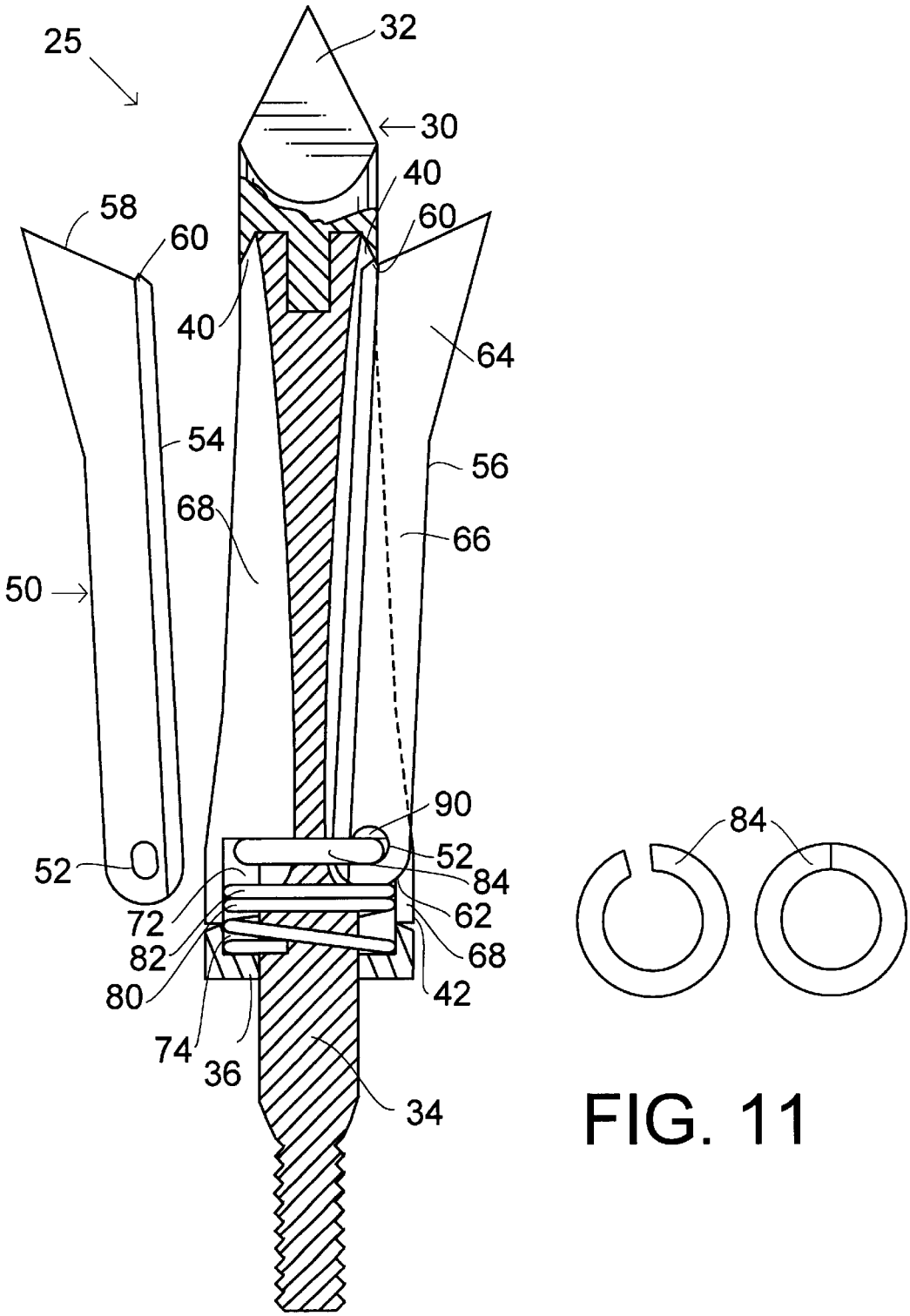
FIG. 11 is a full length longitudinal cross-section of a blade-opening arrowhead according to another preferred embodiment of this invention, similar to the preferred embodiment illustrated in FIG. 9, except a gap is formed between the blade apertures and hinge pin. The annular hinge pin is shown in a top view also.
Figure 12:
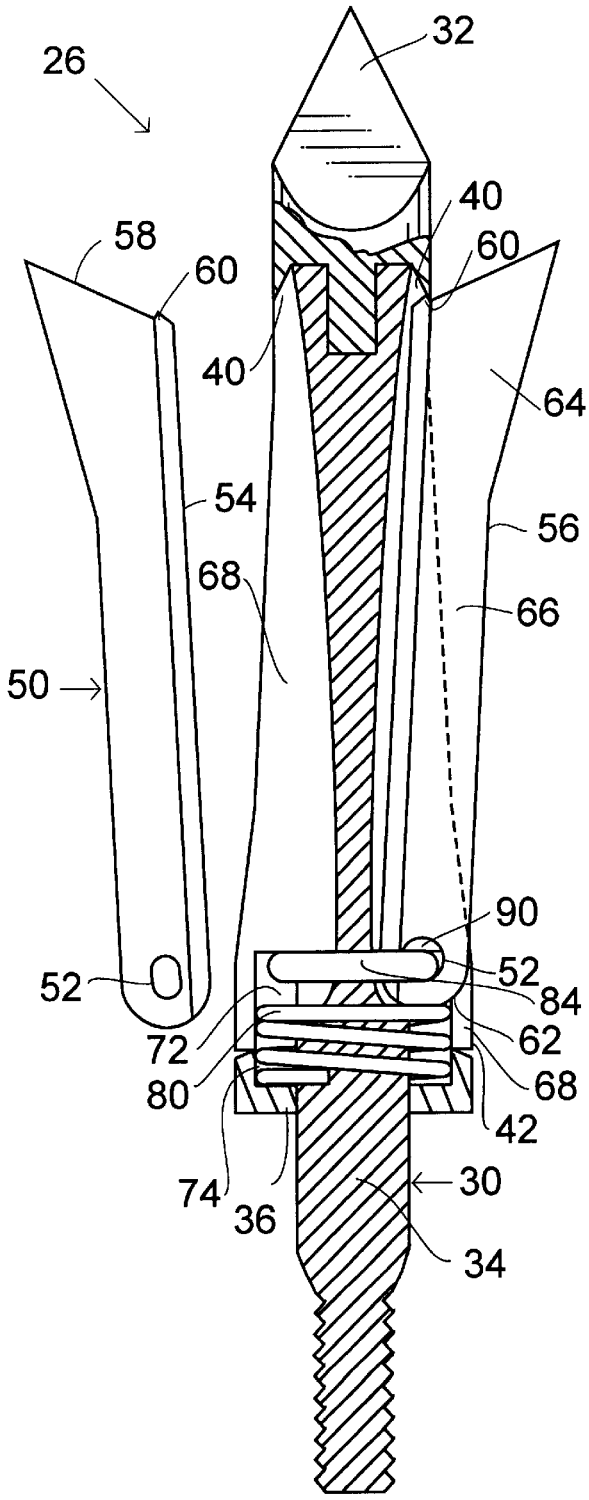
FIG. 12 is a full length longitudinal cross-section of a blade-opening arrowhead similar to the blade-opening arrowhead illustrated in FIG. 11, but without an annular ring. The annular hinge pin is shown in a top view also.
Figure 12:
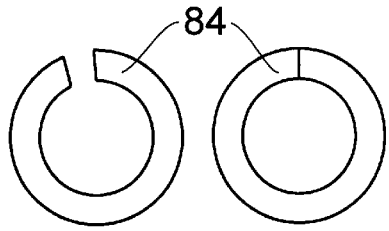

FIGS. 11 and 12 illustrate blade-opening arrowheads 25 and 26, having gaps 90 formed between apertures 52 of blades 50 and annular hinge pin 84, wherein blades 50 are urged when engaging catch lips 60 into notches 40. Particularly, blade-opening arrowhead 25 uses annular ring 82 to equally distribute the urging force to all blades 50, whereas blade-opening arrowhead 26 does not. It is apparent that annular hinge pins 84 or hinge pins 70, gaps 90, apertures 52, and blades 50, can be altered or combined differently than suggested by the various disclosed embodiments of this invention, without deterring from the scope of this invention.

With reference to holding means, tip end 32 of the arrowhead bodies 30 according to this invention, may be removably attachable. For example, tip end 32 may be removably attachable to a substantially frustuconical arrowhead body 30, as clearly shown in FIG. 2, or may be integral with arrowhead body 30, as shown in FIG. 9. Holding means may be comprised of rigid or resilient materials or elements, and may be comprised of voids, notches, cavities, protrusions, lips, or any combination thereof that is suitable to be contiguously engaged with the engaging area or areas of the edge of each blade 50. For example, holding means may comprise bias means. Accordingly, the engaging area of the blade edge will be configured in any sufficient shape such that when received in, or engaged to, the holding means, each respective blade 50, is securely held in the retracted position until the arrowhead penetrates an object or the equivalent. The engaging surfaces of each blade edge and the holding means may comprise any combination of configurations of flat, convex, concave, and inclined, such as flat to flat, flat to concave, and concave to convex. For example, a rigid flat surface of the blade edge may be urged into a resilient flat rubber piece, or a flat rigid blade edge may be urged into a flat rigid area on arrowhead body 30 or the equivalent.

According to this invention, each blade is preferably housed in a respective blade slot or equivalent, configured to receive the blade or blades. The blade slot or slots, are in substantial alignment with the longitudinal axis of the arrowhead body, and may be radially or non-radially orientated. The amount each blade or a particular portion of each blade, is exposed outside the arrowhead body may vary, but will be such that the arrowhead exhibits the excellent arrow trajectory and aerodynamics, characteristic of blade-opening arrowheads, and will have a sufficient moment-arm to lever or rotate the blades quickly and freely to the open position. It is apparent that the blade-opening arrowheads according to this invention may have any number of blades, with two, three or four being preferred. It is apparent that the blade-opening arrowheads according to this invention may have stationary or fixed blades attached to the arrowhead body in combination with the pivotal blades. It is apparent that the different and various elements of this invention may be made of light weight and strong materials, such as composites, aluminum alloys, titanium alloys, stainless steels and other metals and materials. It is also apparent that the arrowhead body of the blade-opening arrowheads according to this invention may be fastened to the forward end of an arrow shaft by any method, such as threading into an insert, or glueing.

The user-friendly and durable nature of the blade retention methods according to this invention provide blade-opening arrowheads that are easy to use, failsafe and worry-free. While the arrowheads are exposed to hard use and harsh conditions in the field, the user will appreciate the simplicity and ease involved in their use. The non-consumable nature, of the blade retention methods of the present invention, allows the archer to simply push the blades back towards the retracted position to securely re-lock the blades in the retracted position, thus quickly and easily readying the arrowhead for repeated use. When compared to prior art spring elements in ruggedness, strength and durability, the annular spring of the present invention better retains its flexibility, and ability to produce an effective urging force. Also, the humanness and lethality of blade-opening arrowheads according to this invention are enhanced over conventional arrowheads, in that the razor sharp cutting edges are continually urged forward, thus providing the ability to cut more tissue.

It is apparent that different bias means, hinge means, holding means and other elements and their equivalents, as discussed above and according to other preferred embodiments of this invention, can be changed, or interchanged, or eliminated, or duplicated, or made of different materials, and connected to or associated with adjacent elements in different manners, other than suggested herein, without deterring from the desired results of the blade-opening arrowheads according to this invention.

It is to be understood that the present invention is not limited to the sole embodiments described above, as will be apparent to those skilled in the art, but encompasses the essence of all embodiments, and their legal equivalents, within the scope of the following claims.

I claim:

1. An arrowhead comprising:

(a) an arrowhead body having a central longitudinal axis, a forward end and an opposing rearward end;

(b) a stem disposed at the rearward end of the body; and (c) a washer having a central through hole and an internally recessed substantially circular void, the void having a bounding internal wall that defines a diameter larger than the diameter defined by the central through hole, the arrowhead being configured such that the through hole of the washer is disposed about the stem when the washer is attached to the body.

2. An arrowhead as recited in claim 1 wherein the circular void of the washer faces open toward the forward end of the arrowhead.

3. An arrowhead as recited in claim 1 wherein the stem has a diameter that is less than the diameter of a section of the arrowhead body located forward of the stem.

4. An arrowhead as recited in claim 1 wherein the circular void houses an annular entity when the washer is attached to the body.

5. An arrowhead as recited in claim 1 wherein when the washer is attached to the arrowhead body an internal circular cavity is created within the arrowhead, a section of the arrowhead body defining a forward most boundary of the cavity.

6. An arrowhead as recited in claim 5 wherein a ring is housed within the cavity.

7. An arrowhead as recited in claim 6 further comprising a cutting blade having an aperture formed therein, the cutting blade being attached to the body such that the ring extends through the aperture thereof.

8. An arrowhead as recited in claim 5 wherein a spring is housed within the cavity.

9. An arrowhead as recited in claim 5 wherein the arrowhead further comprises a blade receiving slot, the slot communicating with the cavity.

10. An arrowhead as recited in claim 5 wherein the cavity aids in attaching a cutting blade to the body.

11. An arrowhead as recited in claim 10 wherein the blade is moveable mounted to the body.

12. An arrowhead as recited in claim 10 further comprising a plurality of blades.

13. An arrowhead comprising:

(a) an arrowhead body having a central longitudinal axis, a forward end and an opposing rearward end;

(b) a stem disposed at the rearward end of the body;

(c) a cutting blade attached to the body; and (d) a washer having a central through hole and an exterior side wall extending thereabout, the arrowhead being configured such that the washer is disposed about the stem, wherein the washer has an internally recessed substantially circular void bounded by the exterior side wall thereof, and the circular void faces open in a direction toward the forward end of the arrowhead body when the washer is attached to the arrowhead body.

14. An arrowhead as recited in claim 13 wherein the cutting blade is movably attached to the body.

15. An arrowhead as recited in claim 14 wherein the cutting blade moves between a closed in-flight position and an open penetrating position.

16. An arrowhead as recited in claim 15, wherein the cutting blade moves in a rearward direction when opening from a closed in-flight position to an open penetrating position.

17. An arrowhead as recited in claim 15 further comprising a plurality of blades.

18. An arrowhead as recited in claim 14 wherein the cutting blade contacts at least a section of the washer when the arrowhead is in an open penetrating configuration.

19. An arrowhead as recited in claim 18 further comprising a plurality of blades.

20. An arrowhead as recited in claim 19 wherein the plurality of blades is three.

21. An arrowhead as recited in claim 13 wherein the body comprises an internally bounded annular recess disposed circumferentially about the stem having a substantially annular ring seated therein.

22. An arrowhead as recited in claim 21 wherein the annular recess having the annular ring seated therein communicates with the circular void of the washer.

23. An arrowhead as recited in claim 21 wherein the blade is hingedly attached to the body by the annular hinge ring.

24. An arrowhead as recited in claim 23 further comprising a plurality of blades.

25. An arrowhead as recited in claim 13 wherein the blade is attached to the body by an annular hinge ring.

26. An arrowhead as recited in claim 13 wherein the arrowhead body is fabricated from aluminum.

27. An arrowhead as recited in claim 26 wherein the arrowhead further comprises a steel tip attached to the body at the forward end thereof.

28. An arrowhead comprising:

(a) an arrowhead body having a central longitudinal axis, a forward end and an opposing rearward end;

(b) a rearwardly extending stem disposed adjacent the rearward end of the body, the stem defining a first cross-sectional diameter;

(c) a barrel section of the arrowhead body located forward of at least a section of the stem, the barrel section defining a second cross-sectional diameter that is larger than the first cross-sectional diameter of the stem; and (d) a washer having a through hole and a forward side, the washer being configured so as to attach to the arrowhead body about the stem such that at least a portion of the forward side thereof contacts with at least a portion of the barrel section of the body, wherein the washer has an internal substantially circumferential void disposed rearward of the forward side thereof.

29. An arrowhead as recited in claim 28 further comprising a tip attached to the arrowhead body.

30. An arrowhead as recited in claim 28 wherein the blade is hingedly attached to the body by an annular hinge ring.

31. An arrowhead as recited in claim 30, wherein the blade moves in a rearward direction when opening from a closed in-flight position to an open penetrating position.

32. An arrowhead as recited in claim 28 wherein the internal void is configured such so as to receive an annular element therein.

33. An arrowhead as recited in claim 28, wherein the arrowhead is a blade-opening arrowhead.

34. An arrowhead as recited in claim 33, wherein the blade moves in a rearward direction when opening from a closed in-flight position to an open penetrating position.

35. An arrowhead as recited in claim 28, wherein the arrowhead comprises a plurality of blades.

* * * * *